US005535924A

United States Patent [19]

Nilsson et al.

[11] Patent Number: 5,535,924

[45] Date of Patent: Jul. 16, 1996

[54] TUBULAR CONTAINER PROVIDED AT ONE END WITH A FIRST CAP, WHICH HAS BOTH A SEALING FUNCTION AND A PLUNGER FUNCTION, AND AT THE OTHER END WITH A SECOND CAP WITH A SPOUT

[76] Inventors: Hugo Nilsson, Gunstorp, Tutaryd, S-341 96 Ljungby; Karl-Eric Johnsson, Åby, S-340 14 Lagan, both of Sweden

[21] Appl. No.: 256,943

[22] PCT Filed: Feb. 8, 1993

[86] PCT No.: PCT/SE93/00096

§ 371 Date: Jul. 27, 1994

§ 102(e) Date: Jul. 27, 1994

[87] PCT Pub. No.: WO93/15977

PCT Pub. Date: Aug. 19, 1993

[30] Foreign Application Priority Data

| | | | |
|---|---|---|---|
| Feb. 14, 1992 | [SE] | Sweden | 9200434 |
| Jul. 27, 1992 | [SE] | Sweden | 9202233 |
| Aug. 12, 1992 | [SE] | Sweden | 9202342 |
| Nov. 9, 1992 | [SE] | Sweden | 9203360 |

[51] Int. Cl.[6] ..... B67D 5/32

[52] U.S. Cl. ..... 222/153.06; 215/256; 220/276; 222/327; 222/386

[58] Field of Search ..... 222/153.05, 153.06, 222/153.07, 325, 326, 327, 386; 220/276; 215/256

[56] References Cited

U.S. PATENT DOCUMENTS

| | | | |
|---|---|---|---|
| 2,478,078 | 8/1949 | Buttenfeld | 222/327 |
| 2,887,253 | 5/1959 | Biedenstein | 222/327 |
| 2,941,699 | 6/1960 | Schmidt et al. | 222/327 |
| 3,831,798 | 8/1974 | Rowe et al. | 220/276 X |
| 4,326,650 | 4/1982 | Van Manen | 222/386 |
| 4,331,267 | 5/1982 | Duncan et al. | 222/386 X |
| 4,463,878 | 8/1984 | Crone | 222/153.06 |
| 4,513,889 | 4/1985 | Beard | 222/153.07 |
| 4,605,129 | 8/1986 | Detzel et al. | 206/623 |
| 4,669,630 | 6/1987 | Kenyon, II | 215/256 X |
| 4,934,570 | 6/1990 | Bamberger et al. | 222/386 |
| 4,966,292 | 10/1990 | Marino | 220/276 X |

FOREIGN PATENT DOCUMENTS

| | | | |
|---|---|---|---|
| 7900758 | 10/1979 | WIPO | 222/327 |

*Primary Examiner*—Joseph A. Kaufman
*Attorney, Agent, or Firm*—Davis, Bujold & Streck

[57] ABSTRACT

A container (1) for a lubricant has a cap (31) for sealing of one end (50) of a cylindrical tube (2). The cap shows a bottom (32), from the periphery of which extends in an axial direction a circumferential interior collar (36), which abuts the inside of the tube end and has a double function, namely a sealing function and a second function as a plunger for feeding out the tube contents by the use of a device such as a plunger rod of a pistol-like tool as known per se. To this purpose, the delimitation edge of the interior collar (36) which is turned away from the bottom connects to a bridge (39) located within a radial plane and leading to an exterior collar (40) which is concentric with the interior collar and surrounds the tube end together with the interior collar and the bridge. This cap is provided with a groove-like circumferential weakened part (38) permitting release of the bottom (32) during the transition to a plunger function. According to the invention the weakened part (38) is provided within or at the bridge (39) and the sides of the collars and the tube which are facing each other are provided with circumferential arresting and sealing grooves and bulges, respectively, acting upon the other part for at least temporally positioning or retaining or sealing of the cap (31) in relation to the tube. Furthermore, the other tube end is sealed by a specially shaped cap which is provided with a spout (46), which latter cap co-operates with a likewise specially designed tube end.

18 Claims, 7 Drawing Sheets

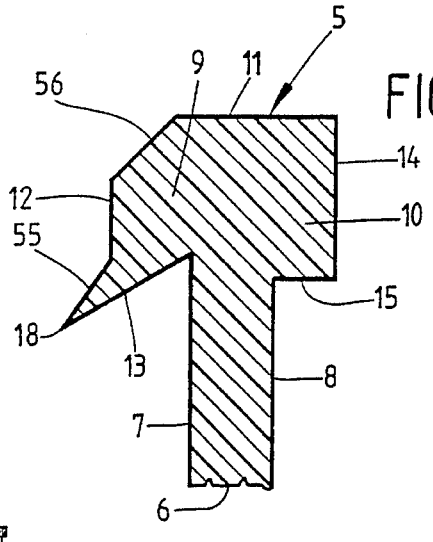
FIG. 8
FIG. 6
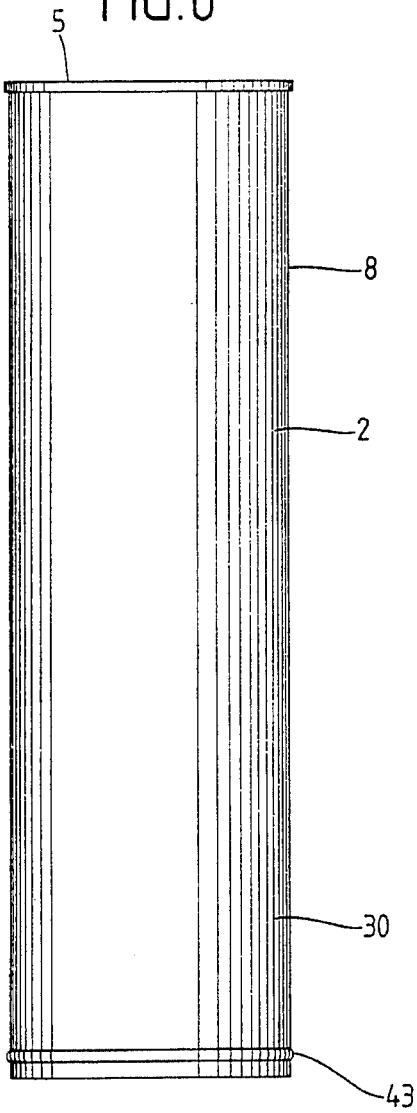
FIG. 7
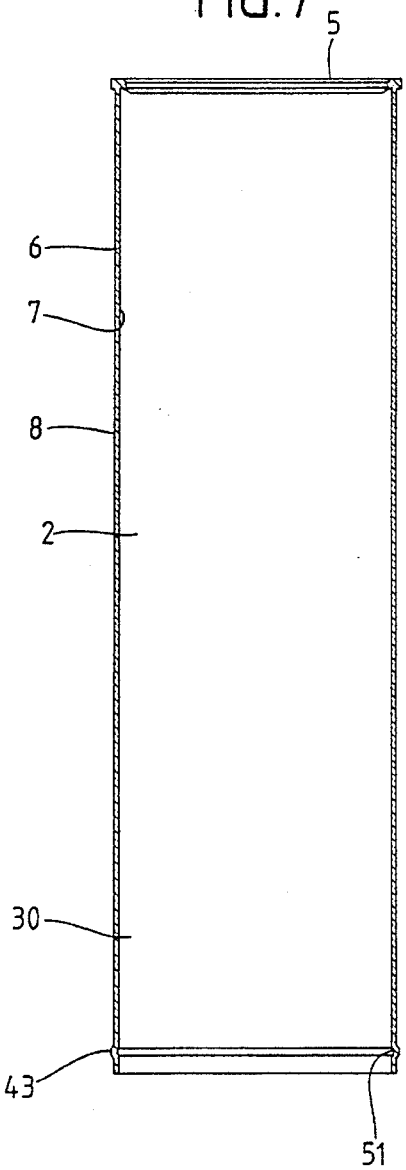

FIG.14
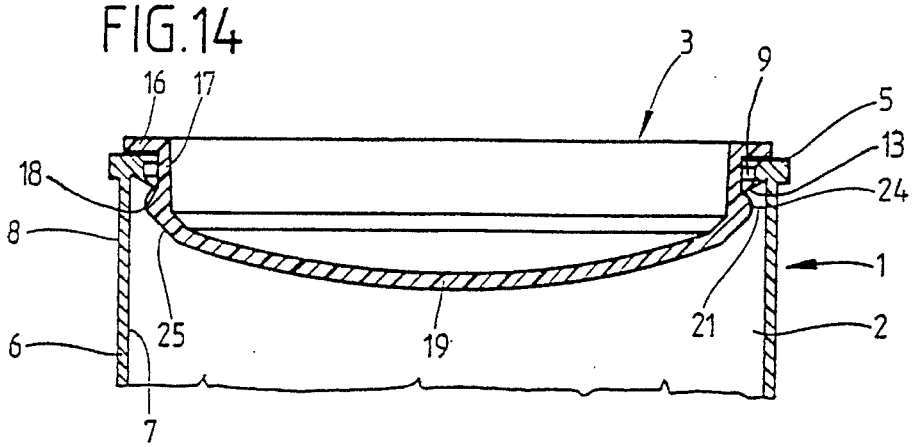
FIG.15
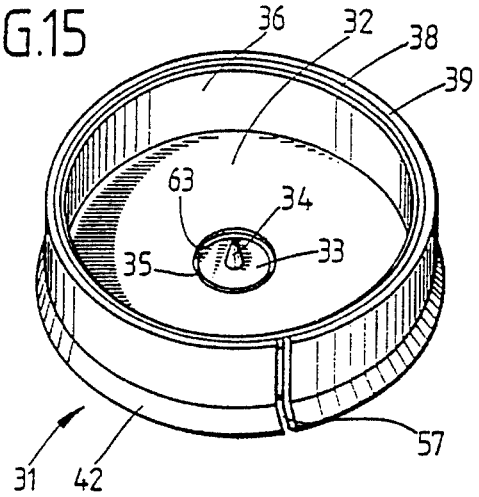
FIG.16
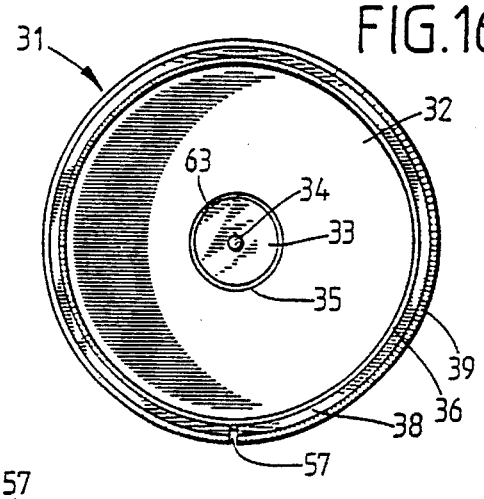
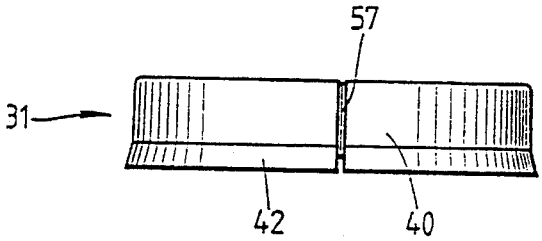
FIG.17
FIG.18
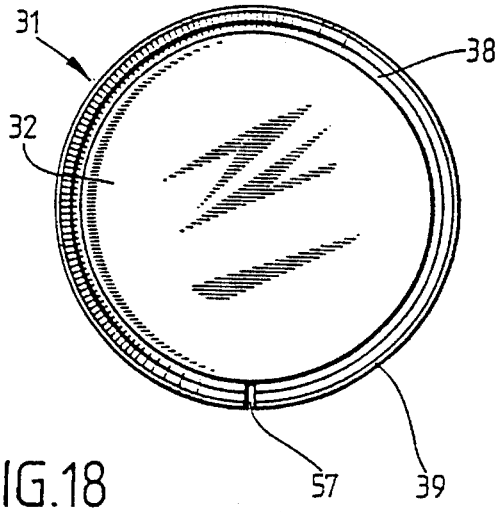
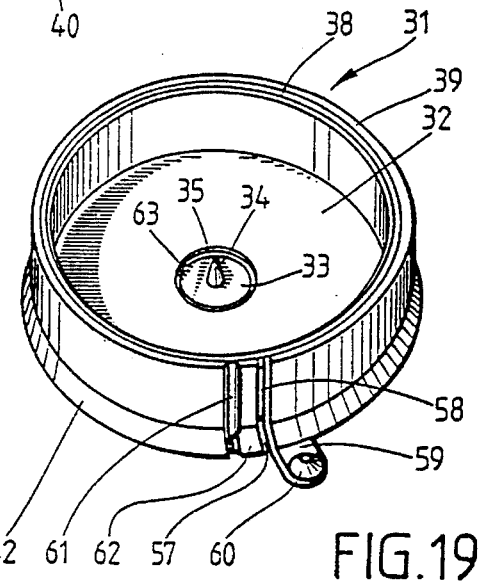
FIG.19

FIG. 20
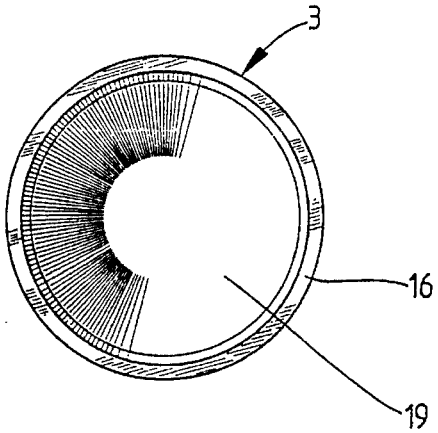
FIG. 23
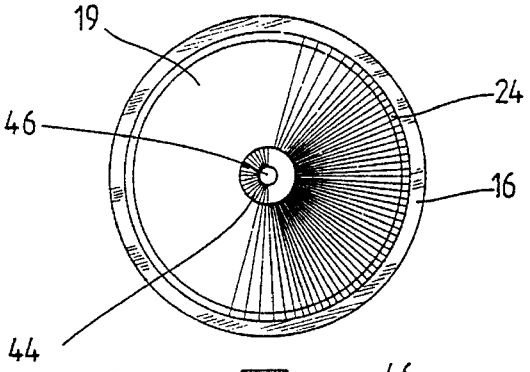
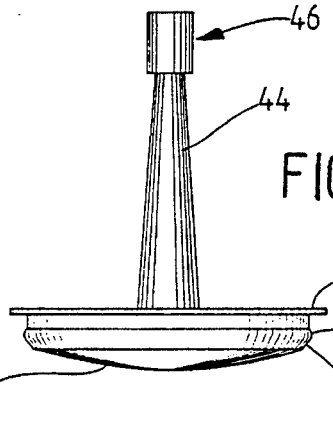
FIG. 24
FIG. 21
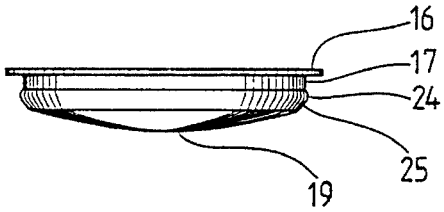
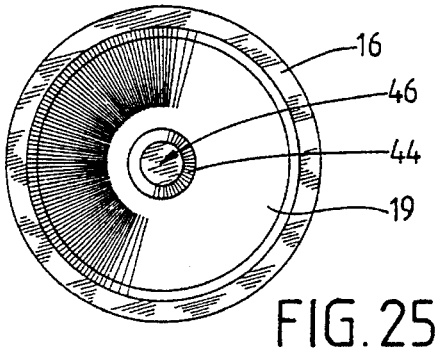
FIG. 25
FIG. 22
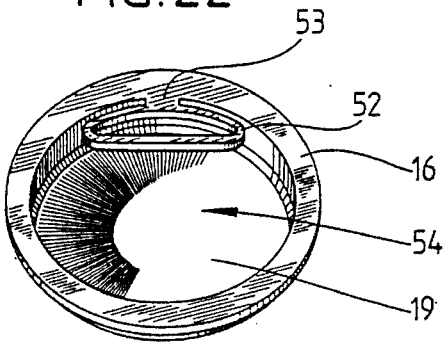
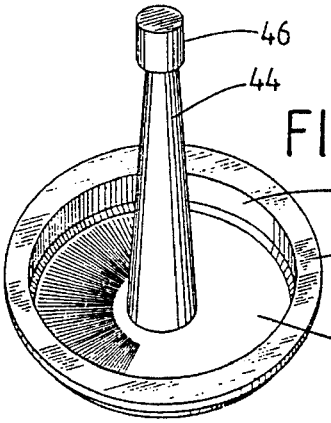
FIG. 26

TUBULAR CONTAINER PROVIDED AT ONE END WITH A FIRST CAP, WHICH HAS BOTH A SEALING FUNCTION AND A PLUNGER FUNCTION, AND AT THE OTHER END WITH A SECOND CAP WITH A SPOUT

FIELD OF THE INVENTION

The present invention relates to a container with at least one closure means for sealing one end of a generally cylindrical tube containing one of a viscous substance, a paste like substance, a lubricant, silicon or a food substance.

The invention is particularly concerned with lubricant cartridges and caps for sealing same.

BACKGROUND OF THE INVENTION

Today, consciousness towards the environment is greater than in the past and containers must fulfill high safety demands, particularly for substances which are detrimental to the environment.

Nevertheless, such containers should be simple and easy to produce at low costs. Their handling should also be easy and simple, both when filling and sealing. Safety must be maintained when using fully automatic sealing as well as repeated sealing, even after numerous opening and closing operations. The closure means should even be able to resist outer and interior strain up to certain levels, so that leakage may be avoided with comparatively great security. Furthermore, the contents of such a container must be fed out in a simple and reliable way.

The previously known containers and their closure means do not fulfill these demands, at least not in combination.

Caps which are previously known in this technical field serve as sealing means for a cartridge or the like between its filling and use. When using the cartridge, the cap is normally removed and thrown away and has, therefore, no further function to fulfill.

Beyond this limited function, previously known caps often suffer from the drawback that they do not safely or sufficiently seal the container. Leakage may thus occur easily and frequently, and quite often full containers and adjacent containers, the contents of which have leaked out, must be thrown away, as it can be rather unpleasant to get ones hands and clothes soiled by the contents of the container.

Apart from the problem of possible leakage, the previously known caps are also hard to remove, particularly caps which are not designed as screwcaps. If the caps are designed as screwcaps, increased material thickness is required, as well as extra means to provide the cap with interior threads and extra means to provide the one cartridge end with outer threads.

Bamberger et al. discloses a cap for sealing one end of a container for fast food. This cap is furnished with a circumferential incision in the middle of an interior collar, which is torn apart when a plunger is pushed against the cap bottom, whereupon said bottom, with approximately half the axial length of the interior collar, serves as a plunger disk for feeding out fast food. Such a design shows drawbacks, as it may be very difficult, and quite remarkable forces may be needed, to make the collar crack within the area of the incision, where the collar continues on both sides in a straight way with the incision at a right angle in relation thereto. For this reason, as clearly revealed by FIG. 8, a need has occurred to increase substantially the thickness of the interior collar above the incision, in which way, obviously, the upper part of the interior collar and the outer collar should be prevented from following the plunger disk, in case the incision does not crack in spite of high pressure. Furthermore, this cap is not fixedly secured at the container in any way and pressures arising within the latter, e.g. when squeezing the container, would immediately lead to gliding of the cap away from the container. Even the feeding out of the contents of the container has to be regarded as disadvantageous, as that part of the interior collar which forms the plunger disk undergoes a change of shape from a position of rest with a shape converging towards the contents of the container, to a parallel position when plunger pressure is applied, whereby some of the contents of the container most probably will enter between the interior collar and the container wall, thus preventing a normal plunger function or leaking out backwards along the free edge of the interior collar. Finally, the remainder of the interior collar and the outer collar left behind on the container end are not secured in any way. These parts may be dislodged unintentionally at any time and thus constitute a waste problem. Such a closure means may, to a limited extent, be tolerated for harmless substances, e.g. fast food. It is, however, undoubtedly unsuitable for substances which are detrimental to the environment, such as lubricants and the like.

SUMMARY OF THE INVENTION

One objective of the present invention, therefore, is to provide a container with closure means which, avoiding or counteracting the above-mentioned drawbacks, fulfills the above-mentioned demands in combination.

Another objective of the invention is to improve previously known containers and their closure means in various respects, particularly as to facilitating application of caps, guaranteeing the applied position of the caps in spite of considerable outer and/or interior strains such as pressure, and to make possible a fast, easy and simple removal of said caps when so desired.

Furthermore, there should be material savings, and a fast, simple and safe transition to a plunger function of the cap without damage to the cap or other parts of the container. The cap parts remaining, in certain cases, at the container after separation of the plunger should be secured against unintended release. The transition of the cap from a sealing to a plunger function should be achievable in a simple way either manually, e.g. by tearing off an outer collar, or mechanically/automatically by placing the container into a device, e.g. a pistol like tool. There should be means for safely controlling, guiding, and sealing the plunger, and the line of fraction in the cap to produce a plunger shall permit relatively easy separation and great safety against undesired separation. Relevant parts of these properties should also prevail at an optional cap, sealing the other container end, and having solely a sealing function. The container as such should be designed to further such properties in a far-reaching way, whereby tolerances, shrinking, etc. shall be controlled.

These objectives are achieved, according to the invention, by a container and at least one closure means, comprising a cap for sealing one end of a generally cylindrical tube containing at least one of a viscous substance, a paste-like substance, a lubricant, silicon, and a food substance; a bottom on said cap; a circumferential interior collar projecting from a periphery of said bottom in a substantially axial direction, and abutting an inside of an end of said tube; said cap functioning as a sealer and as a plunger for feeding out said tube contents; a border edge of said interior collar turned away from said bottom; a bridge connected to said border edge, located substantially within a radial plane; an exterior collar connected to said bridge, being substantially concentric with said interior collar and surrounding said tube end along with said interior collar and said bridge; an annular groove on said interior collar proximate said bridge, having a reduced thickness, permitting release of said bottom during transition of said cap into said plunger; at least one circumferential arresting means provided on a surface of said collar and said tube for one of positioning, retaining, and sealing said cap in relation to said tube; an axial cut in said exterior collar, having one of a lack of width and a gap of about 1 mm, said axial cut extending radially through at least a major part of said exterior collar, forming a tear-off indication; and an axial, substantially cone-like projection provided centrally on a first surface of said bottom, said projection being used as at least one of a localization and centering means for a plunger rod of a feeding mechanism for feeding out said contents of said container; a concentric groove surrounding said projection, said groove reducing a thickness of said bottom; a bridge extending radially through said groove connecting said projection to a remainder of said bottom, said projection being removable, forming a hole into which a spout is insertable.

BRIEF DESCRIPTION OF THE DRAWINGS

Further characteristics and advantages of the invention are revealed by the following detailed specification with reference to the accompanying drawings, which in a partly schematic way show preferred embodiments. In the drawings:

FIG. 6 is a side elevational view of the tube shown in FIGS. 1 and 5;

FIG. 7 is a diametrical axial sectional view of a tube shown in FIGS. 1, 5 and 6;

FIG. 8 is a magnified sectional view of the one end profile of a tube according to FIG. 7;

FIG. 14 is a magnified view of the upper part of FIG. 12;

FIGS. 15–18 show the plunger cap according to FIG. 13 in a perspective view from above as well as a top plan view, a side elevational view and an underneath plan view;

FIG. 19 is a perspective view from above of a modified cap similar to the one of FIGS. 15–18;

FIGS. 20–22 show the cap according to FIG. 14 seen from below, from the side and in a perspective view from above; and FIGS. 23–26 show the spout cap of FIG. 10 seen from below, from the side, from above and in a perspective from above.

DESCRIPTION OF THE PREFERRED EMBODIMENTS

Figure 5:
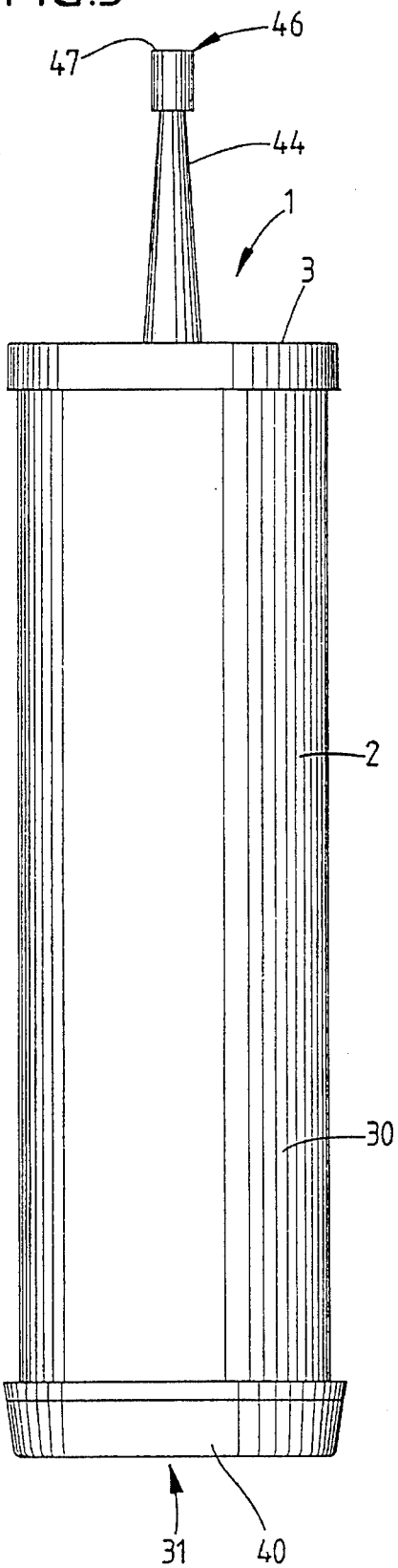
FIG. 5 is a side elevational view of the container shown in FIG. 1.
Figure 1:
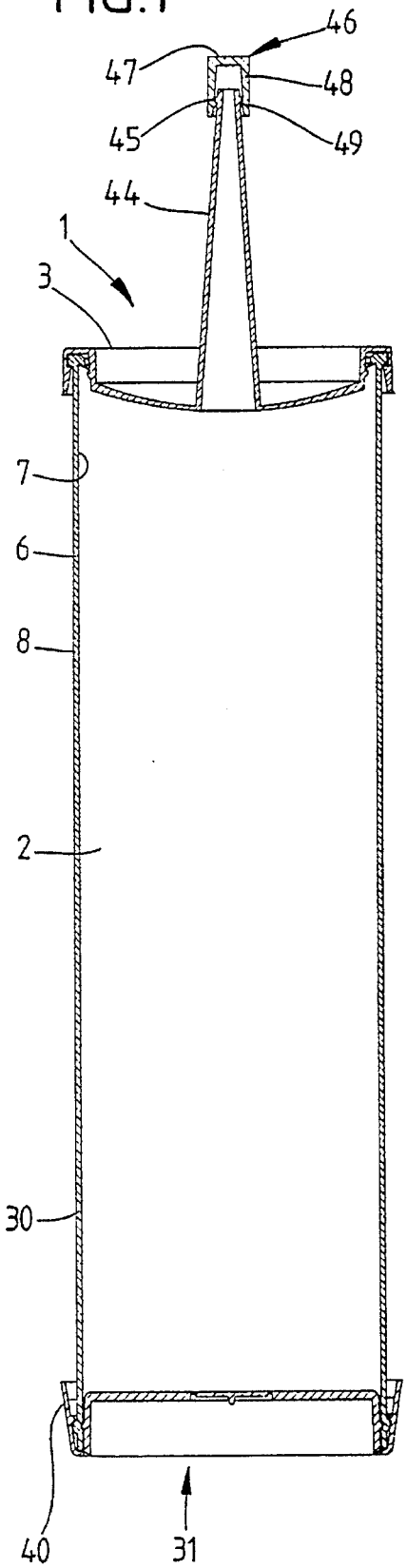
FIG. 1 is a diametrical axial sectional view of a first embodiment of a container according to the invention consisting of a circular cylindrical tube and two caps sealing same.
Figure 2:
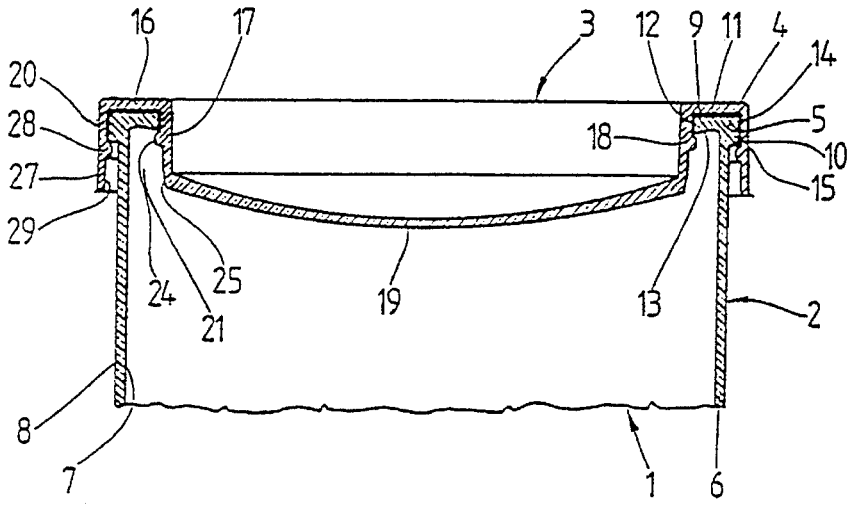
FIG. 2 is a partial diametrical axial sectional view of a second embodiment of a closure means according to the invention similar to the one of FIG. 1 but with a modified cap.

Turning to FIGS. 1 and 2, a container according to the present invention is designated in its entirety by 1. This container 1 comprises a preferably circular cylindrical tube 2, which preferably is made of plastic material by injection molding. The other part of the container, which is optional, is a cap 3, which is at least partially matching in shape. The tube 2 is preferably made of polyethylene HD 7028 and the cap 3 of polyethylene LD+HD.

The tube 2 may contain a flange 5, which preferably surrounds the one tube end 4. In accordance with a preferred embodiment, this flange extends radially both inwardly and outwardly from the respective cylindrical surfaces 7 and 8 of the tube wall 6 to form an interior flange 9 and an exterior flange 10.

In accordance with a preferred embodiment, the interior flange 9 projects longer from the adjacent cylindrical surface 7 than the outer flange 10 does from its adjacent cylindrical surface 8. Typically, the interior flange 9 may project 1–3 mm, preferably approximately 2 mm, while the exterior flange 10 may project 0.5–2.5 mm, preferably approximately 1 mm. This makes the interior flange 9 create a greater retaining force in relation to the cap 3 than the exterior flange 10. In this way, a cap 3 attached to the tube 2 may resist comparatively great strain, particularly strain which arises when the contents of the container 1 are subjected to squeezing, which propagates a pressure on the cap 3 from the inside, e.g. when a tube 2 falls down or is harshly grasped. At the same time, it is nevertheless, relatively easy to remove the cap 3, as the free exterior edge of the cap 3 outside the tube 2 is grasped and heeled over and away from tube end 4, with the radially shorter exterior flange 10 offering less resistance.

The interior flange 9 and the exterior flange 10 suitably share a common upper delimitation surface 11 forming the free axial end surface of tube end 4.

In accordance with a preferred embodiment, the interior flange 9 is shorter in axial direction than the exterior flange 10. Typically, the interior flange 9 can be 1–3 mm, and is preferably approximately 2 mm long, while the exterior flange 10 can measure 2–4 mm, and is preferably approximately 2.5 mm in an axial direction, whereby an interior sealing surface 12 and an exterior sealing surface 14 are formed, which preferably are situated within cylindrical, mutually coaxial surfaces. While the exterior flange 10 is terminated at its axial end, which is turned away from exterior sealing surface 14 by a shoulder 15, which is preferably situated within a radial plane, the interior flange 9 is terminated within a corresponding region, preferably as an undercut surface 13, which may be straight or concave to form a pointed annular edge 18, the purpose of which is to exert an extra sealing effect in relation to cap 3. The angle included between surfaces 12 and 13 amounts to 30°–85°, preferably approximately 70°. Another angle other than 90° between surfaces 11 and 12 is conceivable, namely an angle larger than 90°, e.g. 90°–130°, preferably approximately 110°. It is also possible to provide at the outer part of surface 12 a bevel or curve to facilitate the pushing of a cap 3 onto the tube 2.

The cap 3 itself partially matches the shape of tube end 4 as shown and described. Accordingly, the cap 3 has, situated within a radial plane, a ring part 16, which inwardly connects to a circular cylindric interior ring part 17, which is closed by a bottom 19, which preferably is slightly concave seen from outside. These three parts 16, 17 and 19 have approximately the same material thickness, that is, 1 mm. Outwardly, ring part 16 connects to a circular cylindric outer ring part 20, which is equally as long as, or somewhat longer in axial direction, than the interior ring part 17, measured from ring part 16.

Parts 16, 17 and 20 define an annular groove 21 for receiving and arresting tube end 4. To this purpose, ring parts 17 and 20 are provided with circumferential shoulders 24 and 28, respectively, which face each other, but are offset somewhat in an axial direction in relation to one another, corresponding to the previously described and shown difference in axial extension between interior flange 9 and exterior flange 10. With a cap 3 firmly applied, said shoulders 24 and 28 are provided directly below undercut surface 13 and shoulder 15, so that the cap 3 may not be removed without considerable stretching away from tube end 4. It is to be appreciated that shoulders 24 and 28 may be bulges or other shapes which prevent unintentional removal of cap 3.

The free axial half 27 of outer ring part 20 may optionally be bent outwardly somewhat, or provided with a circumferential interior bevel 29 for facilitating pushing the cap 3 onto the tube end 4. For the same purpose, that half of interior ring part 17, which connects to bottom 19, may be provided with a bevel 25.

As the outer ring part 20 does not have to develop similar properties to resist unintended release of the cap 3, and the cap 3, to a certain extent, should be removable intentionally, the outer ring part 20 is suitably thin, e.g. approximately 0.7 mm thick, while the ring parts 16 and 17 and even the bottom 19 may be approximately 1 mm thick, all in accordance with one non-limiting embodiment.

Beyond the effects described hereinbefore, the closure means according to the invention is characterized by the following properties. In the normal sealed position, according to FIG. 2, excellent sealing is achieved around the entire periphery of the inside, endside and outside of the tube 2. If so desired, annular groove 21 may be furnished with a sealing agent, e.g. silicon, in connection with the filling and sealing of the tube 2 at a factory. In this way, extra safety against leakage during handling is achieved.

If a filled tube 2 sealed by a cap 3, as described and shown, is exposed to interior pressure for a reason as described before, such pressure will affect primarily the cap bottom 19, which is pushed upwards to attain a more flat shape, whereby ring part 17 is pressed against or towards the tube wall 6 within the connecting region between this part and the bottom 19 and will increase the sealing pressure of the shoulder 24 against and around annular edge 18. The pointed shape of the annular edge 18 guarantees, in a far-reaching way, that the cap 3 may not be released at minor or medium size pressures from the inside.

When applying pressure from the outside on the cap bottom 19 in an axial direction, ring parts 16 and 20, and particularly the shoulder 28 will resist such pressures to a practically unlimited extent. The shoulder 28 functions here as some kind of heeling stop, which prevents, in combination with shoulder 15, the peripheral channel part of the cap 3 from "gliding" inwardly around tube end 4.

On the other hand, if it is desired to remove the cap 3, possibly only temporarily, this may be achieved relatively simply and easily by grasping the free axial half 27 at any place and pulling and bending that place upwardly, so that the shoulder 28 may pass beyond shoulder 15. This is facilitated by shaping ring part 20 somewhat thinner than ring parts 16 and 17, and manufacturing the cap 3 in general of a flexible plastic material and/or of a material which is less flexible per se, but still flexible, due to the material thickness chosen. Upon continued pulling away of the cap 3, the shoulder 24 glides along and eventually beyond annular edge 18, until the cap 3 is entirely removed.

To reseal the tube 2, the cap 3 is attached loosely to tube end 4 and is then pushed until the shoulders 24 and 28 of the cap 3 have glided past annular edge 18 and the shoulder 15 of the tube end 4, elastically deforming the cap parts concerned, and eventually snapping behind the annular edge 18 and shoulder 15 and arresting the cap 3 in this position.

Figure 3:
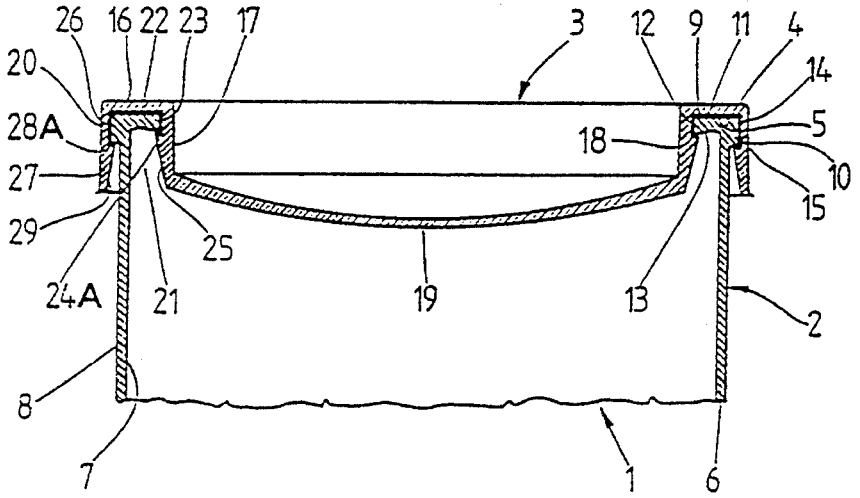
FIGS. 3 and 4 are partial diametrical axial sectional views of a circular cylindrical tube according to the invention sealed at the one end by a cap similar to the one shown in FIG. 2 and at the other end by a third embodiment of a cap according to the invention.

As can be seen, the embodiment according to FIGS. 1 and 2 differs from the one shown in FIG. 3 only in that the shoulders 24 and 28 have been replaced by bulges **24*a* and 28*a* and by shaping the bevels 25 and 29** in a more reduced way.

Figure 4:
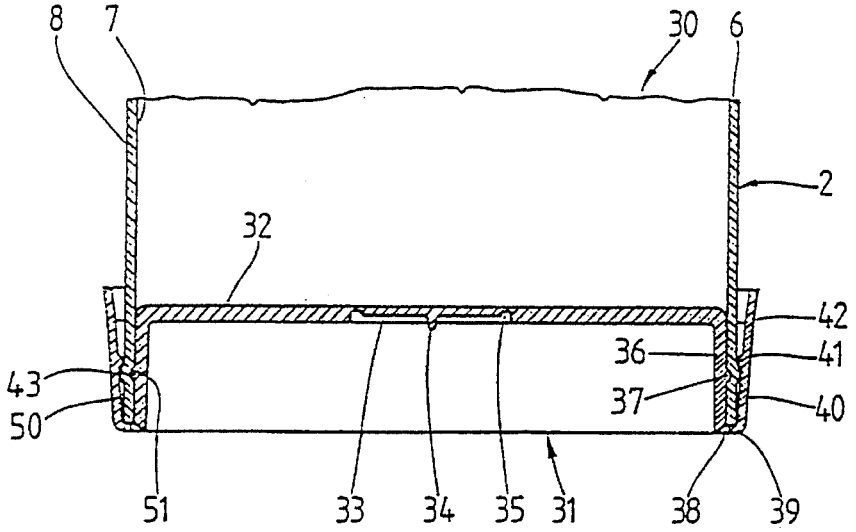
Figure 9:
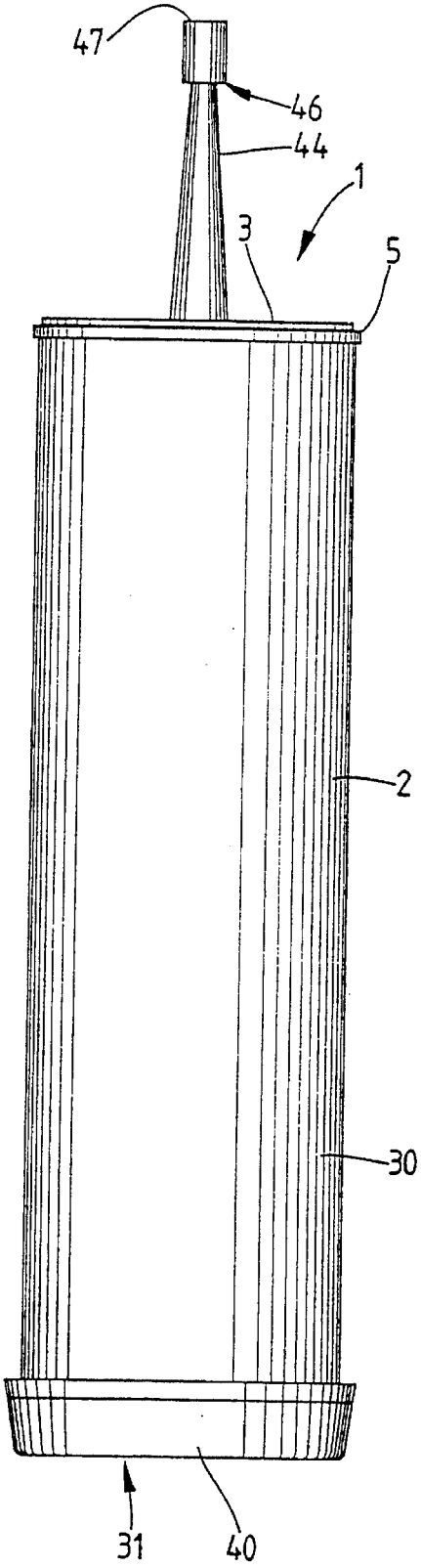
FIG. 9 is a side elevational view similar to the one of FIG. 5 of a modified embodiment.

FIGS. 3 and 4 show an at least principally preferred embodiment of a tube according to the invention provided with two different closure means, one at each end. The one cap 3 and the one tube end 4 are suitably identical or similar to the upper part of FIG. 1 or FIG. 2, while the other closure means differs therefrom and is designated in its entirety by 30. The closure means 30 comprises a cap 31 having a preferably flat bottom 32 which substantially fills the interior of the tube 2, and which centrally may be provided with a circular recess 33 with a central protrusion 34 and a peripheral annular groove 35. Parts 33–35 are provided to be abutted by a plunger rod of a device such as a grease gun. These parts may be removed by pushing away this circular recess 33 which, however, remains connected to the surrounding bottom part 32 via a small radial bridge 63, which is not shown in FIG. 4 but in FIGS. 15, 16, and 19. In the so formed hole, a spout of some kind, e.g. similar to the one shown in FIG. 1, may be inserted.

The bottom 32, which is inserted into tube 2 is surrounded by an interior collar 36, which reaches up to and somewhat beyond the respective tube end 50 and is, at this end, provided with an annular groove 38, which cross-sectionally suitably is wedge-shaped, preferably opening outwardly in an axial direction, and which is provided in a bridge part 39 abutting said tube end 50 in a butt way. Said bridge part 39 connects immediately outside of said tube end 50 to an exterior collar 40 abutting said tube end 50 from the outside and having, approximately in the middle of its axial extent, an annular bulge 41 abutting said tube end 50 and being provided to grasp around and beyond an annular bulge 43 on tube end 50, with annular bulge 43 thereby forming an annular groove 51 on the inside of the tube 2, and a circumferential bulge 37 formed on the interior collar 36 is inserted into the annular groove 51. The free end part of the exterior collar 40 may be bent somewhat outwardly and/or form an interior bevel 42 for facilitating pushing of the cap 31 onto this tube end 50.

The cap 31 even functions as a plunger. The exterior collar 40 may be torn away or the bottom 32 with the interior collar 36 may be sheared away without tearing away the exterior collar 40. The shearing away of the interior collar 36 is facilitated by the substantially reduced thickness of the bottom of the annular groove 38, and by the fact that the bottom of the annular groove 38 is placed directly against the interior edge of the tube end 50, since this edge normally is relatively sharp, and by the fact that the bridge part 39 is butted against said tube end 50, whereupon a plunger rod of a grease gun (not shown) may push the so formed plunger part of the cap 31 into the tube 2, overcoming the retaining force created by bulges and grooves 37, 41, 43 and 51. The retaining force of the annular bulge 41 of the exterior collar 40 may have possibly been eliminated by tearing away the exterior collar 40.

If the exterior collar 40 remains on the tube 2, the exterior collar 40 does not have to be provided with a special tearing means and is partly secured in its position after separation from the interior collar 36 and the bottom 32 in that the bridge part 39, even after separation, will abut the respective tube end 50 from one direction and the annular bulge 41 will grasp around the annular bulge 43 from the opposite direction. Furthermore, when separating the plunger, constituted by the bottom 32 and the interior collar 36, from the exterior collar 40, which remains in position, the circumferential bulge 37 of the interior collar 36 will be retained in the annular groove 51 of the tube 2 until a certain pressure has developed from the plunger rod acting upon the cap bottom 32. When exceeding this pressure, circumferential bulge 37 is released in a snap-like way out of annular groove 51 and the actual pressure level will then have a sudden impact on the bottom of the annular groove 38, shearing off its thin bottom against the underlying interior edge of the tube end 50. In this way, a high threshold is achieved preventing unintended breakaway of this closure means, and at the same time allowing the cap bottom 32 and the interior collar 36 to be used as a plunger if desired.

The axial length of the interior collar 36 is preferably approximately 1 cm. The end of the interior collar 36 which is turned away from the bottom is provided with a slight bevel. The radial extent of the bridge is between 0.2 mm and 5 mm, and is preferably 1–2 mm. The thickness of the bridge 39 within the weakened part 38 is approximately 1/10th of the thickness of the interior collar 36, the latter preferably being approximately 1 mm thick, the weakened part being approximately 0.1 mm thick. The exterior collar 40 has a thickness, which is equal to or less than the thickness of the interior collar 36, e.g. approximately half the thickness of the interior collar 36. In any case, the exterior collar 40 has a thickness greater than the thickness of the bridge 39, and the bottom 32 is preferably thicker than both collars 36, 40, preferably approximately twice as thick as the exterior collar 40.

The spout 44 according to FIGS. 1, 5, 9, 10 and 23–26 may be an outwardly conically converging pipe having an annular bulge 45 at its free end, surrounded by a small cap 46 with a bottom 47 and a sleeve wall 48, on the inside of which there is an interior annular bulge 49. The spout is preferably integrated with the cap according to FIGS. 1, 5, 9, 10 or 23–26.

The cap 3 shown in FIGS. 2 and 3 by way of two different embodiments is shown, in FIGS. 9–12, 14 and 20–26, in a third, preferred embodiment. The ring part 16 of cap 3 preferably does not project radially beyond tube flange 10 but terminates somewhat before reaching the latters outer edge.

Figure 10:
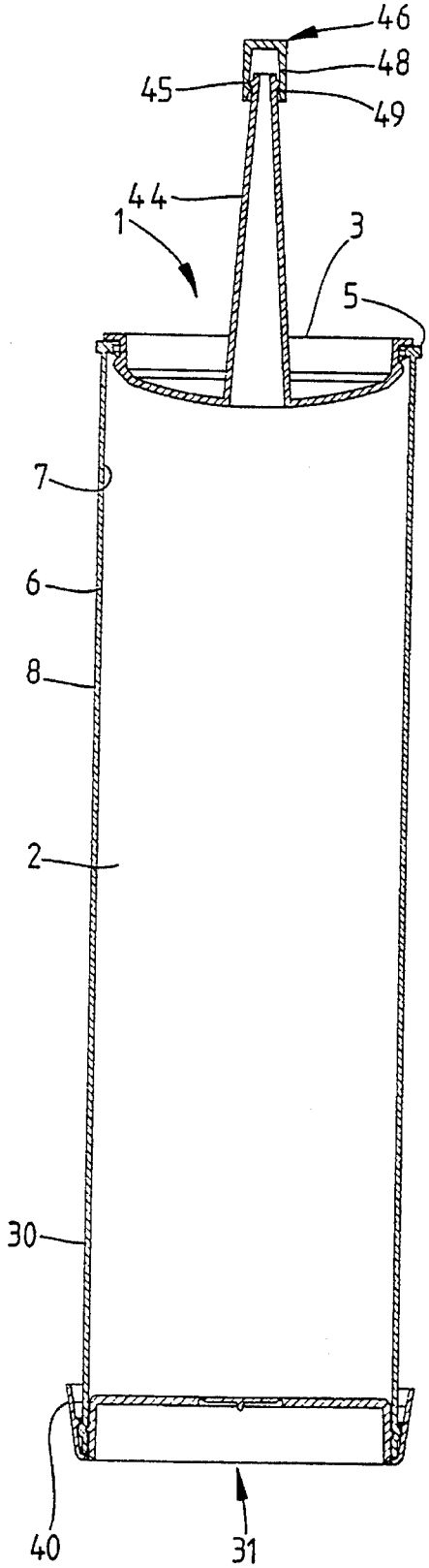
FIG. 10 is a diametrical axial sectional view of a tube according to FIG. 9.
Figure 11:
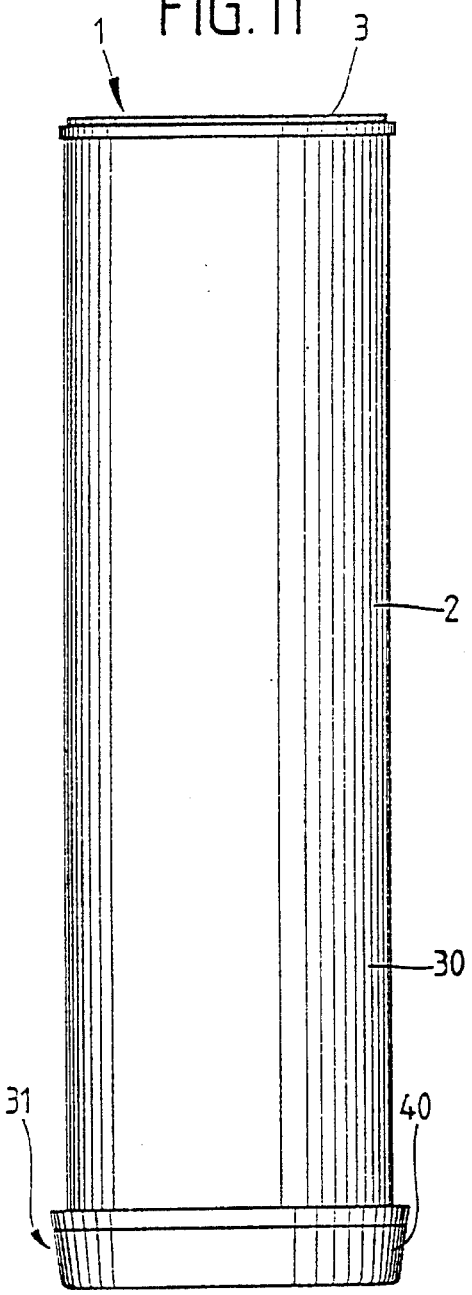
FIG. 11 is a side elevational view similar to the one of FIG. 5 of a further modified embodiment.
Figure 12:
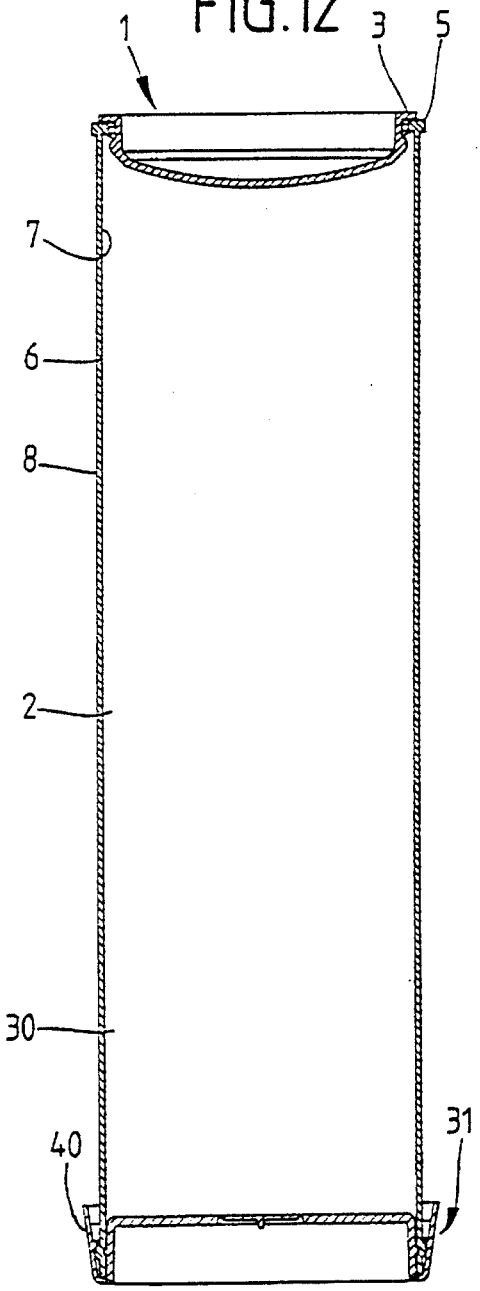
FIG. 12 is a diametrical axial sectional view of the tube according to FIG. 11.

FIGS. 21 and 24 reveal clearly how the bulge 24 projects from the interior ring part 17 of the cap 3. Beyond the bulge 24, the cap 3 begins to incline obliquely inwardly for connecting to a bowl-like bottom 19. Within the region for such a cap 3, tube 2 is either shaped to follow the outside of the cap 3 corresponding to the shape of tube end 50 or is shaped as shown in FIGS. 10, 12 and 14. This shape prevents the contents of the cartridge from being spilled and keeps the cap 3 securely fixed. The attachment of the cap 3 is facilitated and its unintended removal is prevented since the bulge 24 downwardly forms a longer bevel with a minor angle, e.g. 30°–45°, in relation to interior ring part 17, and upwardly is rounded at a minor radius with an angle of e.g. 45°–90° close to the sidewall.

FIG. 22 shows the cap 3, seen obliquely from above, disclosing an almost triangular gripping handle 52, which is intended to facilitated removal of the cap 3. The gripping handle 52 is formed in one piece with the cap 3, and is connected to a spot-like region uppermost at interior ring part 17 via a small tongue 53, forming a transition into the upper inside of the ring part 16 of the cap 3. The wide ring part 16 prevents the cap 3 from being pushed into the tube 2. The cap 3 is preferably manufactured as one homogeneous piece, e.g. by injection molding, preferably of PVC.

A combination of FIGS. 22 and 14 makes it obvious that, when pulling the handle 52, due to the position of handle 52 within the upper cavity 54 of the cap 3 and the spot-like connection to interior ring part 17, the applied pulling force will have a direction substantially in line with the upper curving of bulge 24. Consequently, an initial spot-like removal of the bulge 24 and the cap 3 from the annular edge 18 of the tube 2 is facilitated, and the spot-like "cracking" of the connection between the cap 3 and the tube 2 then will continue fast along the entire annular edge 18 until the cap 3 is totally removed. If the cap 3 is provided with a spout, a handle 52 is preferably omitted.

A cap 3 is, however, suitably provided at tube end 4 according to FIGS. 2, 3 or preferably uppermost in FIGS. 1, 6, 7 and 8 where, like in FIG. 14, the profile of this tube end 4 is shown clearly. This profile shows parts 5–15 and 18 similar to corresponding parts in FIGS. 2 and 3. The extension of interior flange 9 inwardly may, however, be less, while the undercut surface 13 may be more vigorously shaped by an acute angle of e.g. approximately 30° in relation to a radial plane.

The annular edge 18 is shaped as a pointed lip, which projects obliquely downwardly and inwardly from surface 12 and forms, with its upper side 55, an angle of 100°–160°, preferably approximately 140°, while the radial length from surface 12 in a practical example may be 0.5–5 mm, preferably approximately 1 mm. FIG. 14 shows, clearly, how annular edge 18 enters into the angled region between interior ring part 17 and bulge 24 of the cap 3. The annular edge 18, which is flexible, in part due to its shape, will thereby easily follow certain deviations and movements and accordingly will easily compensate for material shrinking, even in combination with the cap 3. The annular edge 18 assists in keeping the cap 3 in place and increases the efficiency of such a sealing arrangement both at arising interior pressures with expansion of the cap bottom 19, in accordance with the previous description, and initially, when removing the cap 3, by elastically following all movements. The annular edge 18 enters, thanks to its pointed shape, somewhat into the cap 3 material and increases the sealing effect even more. A bevel 56 is provided uppermost in the transitional region between flange 5 and surface 12, as shown in FIG. 8, and this profile facilitates insertion of a cap 3, particularly in combination with a bottom bevel 25 on cap 3.

FIG. 19 shows a modified plunger cap embodiment having many possible features, of which all but the annular groove 38 in the bridge 39 may be dispensed with.

At preferably one location, the exterior collar 40 is cut apart or slit by an axial cut 57, which may lack width or form a gap of approximately 1 mm width. This cut 57 extends radially at least through the major part of, and preferably the entire, exterior collar 40 and even through the bridge 39. It is, however, conceivable that the cut 57 does not penetrate the exterior collar 40 entirely in a radial direction, but leaves a thin skin 58, which preferably is situated at the inside of the exterior collar 40 and assures that the exterior collar 40 extends uninterruptedly around the outside of the cap 31 or contributes to an uninterrupted outside of the cap 31, the importance of which will be explained more explicitly below. Within the region of the bridge 39, the cut 57 may possibly be enlarged from an axial to a peripheral extension connecting to annular groove 38, in which way a tearing-off-means may be provided, which will be explained more explicitly below.

Adjacent cut 57, there projects from the exterior collar 40, either in the same direction as the exterior collar 40 or within a radial plane, a tongue 59, which at its free end on the upper side is provided with a protrusion 60 serving as gripping means. By gripping the tongue 59 and its protrusion 60 and pulling them outwardly, one can tear off the exterior collar 40, whereby the thin bottom of groove 38 will be torn apart, and preferably a thin and pointed circumferential lip forms the remainder of the groove 38 bottom in a radial direction at the axially and radially outermost situated part of the interior collar 36.

Figure 13:
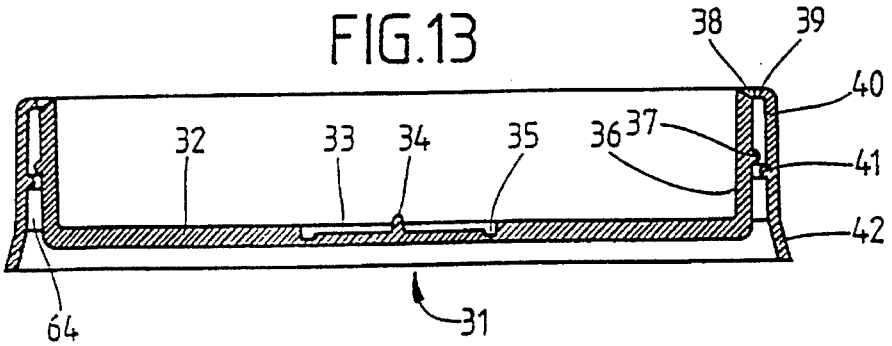
FIG. 13 is a magnified diametrical axial sectional view of a plunger cap according to FIGS. 1, 4, 5 and 9–12.

In parallel relation to cut 57, there may possibly be similar cuts 61 leaving a flap 62 of some millimeters width on the exterior collar 40. It is to be appreciated that the tongue 59 alternatively may be attached to the flap 62. In addition, several extra cuts 61 may be distributed along the periphery of the exterior collar 40, so that expansion of the exterior collar 40 will easily be possible, when the cap 31 is applied to one end of a tube 2 such as a lubricant cartridge, which end will enter into an annular gap 64 formed between the exterior collar 40 and the interior collar 36 with the bridge 39 acting as a bottom limitation, as seen in FIG. 13. Hereby, it is conceivable, when attaching such a cap 31, to introduce simultaneously a bonding agent, which possibly is applied to the inside of the exterior collar 40 and/or the bridge 39, whereby extra safety against leakage will be achieved. The other end of a lubricant cartridge may possibly be sealed by, rather than a cap 3, a bonded skin or a laminate of plastic material and/or metallic foil and/or cardboard, which skin or the like easily may be pierced by an instrument such as a pointed part of a spout, out of which the lubricant is to be fed.

A lubricant cartridge or the like sealed by a cap 31 according to the invention offers great security against leakage, as the interior collar 36 will seal against the inside of the cartridge along a substantial axial extent, while the bridge 39 effects further sealing within a radial plane and the exterior collar 40 finally will render an extra sealing even on the outside of a lubricant cartridge along a substantial part of its actual length. The attachment of a cap 31 according to the invention is a simple procedure, which rapidly may be preformed by means of conventional machines. In further respects, this plunger cap 31 has been described hereinbefore and shown in FIGS. 4 and 13.

Turning to FIGS. 4 and 19, when a lubricant is to be fed out of a tube 2, said tongue 59 is grasped and, rapidly and simply, the exterior collar 40 is torn away, so that only the bottom 32 with the interior collar 36 and a pointed minor part of the bridge 39 remains at the free end of the interior collar 36, which parts all are situated within the tube 2, where the remainder of the cap 31 now advantageously may be used as plunger for feeding out the contents. Hereby, a plunger rod or the like is brought against the outside of the cap bottom 32, possibly with the annular grooves 35 used as a localization and centering means, and the so formed plunger is displaced by means of a plunger rod along the entire cartridge, until its contents have been completely fed out. Hereby, it may be advantageous, if the interior collar 36 runs slightly divergingly away from bottom 32, so that the free edge and said lip of the interior collar 36 abut with certain tension the inside of tube 2. Hereby it is safeguarded that the contents are pressed solely forwardly and can not penetrate in between the interior collar 36 and the wall 6 of the tube 2.

A circumferential bulge 37 at the outside of the interior collar 36 may be a further means acting upon the tube wall 6, either in combination with only said lip-shaped remainder of the interior collar 36 or even with the transitional region between cap bottom 32 and interior collar 36. These parts accordingly may be aligned depending on the above-mentioned design possibilities.

The present invention accordingly offers a very advantageous and practical double function of a cap, and the entire lubricant handling process may prevent spilling, be simpler, be more sensitive to the environment, and even produce cost savings.

The invention is not limited to the embodiments shown and described hereinbefore, and may be modified and completed within the framework of the inventive idea and the following claims.

We claim:

1. A container comprising:

a cap for sealing one end of a generally cylindrical tube containing at least one of a viscous substance, a paste-like substance, a lubricant, silicon, and a food substance;

a bottom on said cap;

a circumferential interior collar projecting from a periphery of said bottom in a substantially axial direction, and abutting an inside of an end of said tube;

said cap functioning as a sealer and as a plunger for feeding out said tube contents;

a border edge of said interior collar turned away from said bottom;

a bridge connected to said border edge, said bridges being located substantially within a radial plane;

an exterior collar connected to said bridge, being substantially concentric with said interior collar and surrounding said tube end along with said interior collar and said bridge;

an annular groove on said interior collar proximate said bridge, having a reduced thickness with respect to said interior collar, permitting release of said bottom during transition of said cap into said plunger;

at least one circumferential arresting means provided on a surface of said collar and said tube for one of positioning, retaining, and sealing said cap in relation to said tube;

an axial cut in said exterior collar, having one of a lack of width and a gap of about 1 mm, said axial cut extending radially through at least a major part of said exterior collar, forming a tear-off indication;

an axial, substantially cone-like projection provided centrally on a first surface of said bottom, said projection being used as at least one of a localization and centering means for a plunger rod of a feeding mechanism for feeding out said contents of said container;

a concentric groove surrounding said projection, said groove reducing a thickness of said bottom; and a bridge extending radially through said groove connecting said projection to a remainder of said bottom, said projection being removable, forming a hole into which a spout is insertable.

2. A container according to claim 1 wherein an axial length of said interior collar is about 1 cm.

3. A container according to claim 2 wherein a thickness of said bridge is about 1/10th a thickness of said interior collar.

4. A container according to claim 3 wherein said thickness of said bridge is about 0.1 mm and said thickness of said interior collar is about 1 mm.

5. A container according to claim 1 wherein an end of said interior collar has a bevel.

6. A container according to claim 1 wherein said bridge has a radial extent of from about 0.2 to about 5 mm.

7. A container according to claim 1 wherein said bridge has a radial extent of from about 1 to about 2 mm.

8. A container according to claim 1, wherein said exterior collar has a thickness equal to said thickness of said interior collar.

9. A container according to claim 1, wherein said exterior collar has a thickness less than said thickness of said interior collar.

10. A container according to claim 1, wherein said exterior collar has a thickness equal to half said thickness of said interior collar and greater than said thickness of said bridge.

11. A container according to claim 1, wherein a thickness of said bottom is greater than a thickness of said interior and exterior collars.

12. A container according to claim 1, wherein a thickness of said bottom is about twice said thickness of said exterior collar.

13. A container according to claim 1 further comprising a circumferential bevel on said exterior collar for at least one of facilitating application of said cap and tearing away said exterior collar.

14. A container according to claim 1 wherein said axial cut leaves a thin skin on a first surface of said exterior collar, making said exterior collar extend uninterruptedly around a first surface of said cap, said axial cut being enlarged from an axial to a peripheral extent, serving as a tear-off indication.

15. A container according to claim 1 comprising:

a tongue projecting from said exterior collar proximate said axial cut;

a protrusion for gripping said exterior collar; and a plurality of axial cuts penetrating at least partially through said exterior collar leaving flaps between each other as tear-off indications.

16. A container according to claim 1 comprising an annular bulge on said exterior collar, abutting said tube, said annular bulge intending to grasp around an annular bulge of said tube, said latter annular bulge forming an annular groove on a first surface of said tube, into which said interior collar is inserted by way of an annular bulge on said interior collar.

17. A container according to claim 16 wherein said exterior collar is torn away;

a bottom of said annular groove on said interior collar is placed directly against said tube end, said tube end having a sharp edge; and a plunger rod of a feeding mechanism pushes said bottom of said tube into said tube.

18. A container according to claim 17 wherein said bottom of said annular groove on said interior collar is placed directly against an interior edge of said tube end, said tube end having a sharp edge;

a plunger rod of a feeding mechanism pushing said bottom of said tube;

said annular bulge on said interior collar nesting in said annular groove on said tube end creating a retaining force to resist said pushing of said bottom until a desired pressure is reached, said pressure releasing said annular bulge from said annular groove, shearing off said annular groove of said interior collar, and releasing said bottom in a snap like manner such that said plunger pushes said bottom into said tube.

* * * * *